United States Patent [19]

Puskarz

[11] 4,102,366

[45] Jul. 25, 1978

[54] DRIVE MECHANISM FOR CONTAINER FILLING MACHINE

[75] Inventor: Stanley J. Puskarz, New Berlin, Wis.

[73] Assignee: A-T-O Inc., Willoughby, Ohio

[21] Appl. No.: 755,177

[22] Filed: Dec. 29, 1976

[51] Int. Cl.[2] ..... B65B 43/50; B65B 43/52

[52] U.S. Cl. ..... 141/150; 141/191; 198/803; 198/854

[58] Field of Search ..... 198/803, 480, 481, 854; 141/129–191, 250–284

[56] References Cited

U.S. PATENT DOCUMENTS 1,096,521 5/1914 Adriance et al. ..... 198/480

*Primary Examiner*—Houston S. Bell

*Attorney, Agent, or Firm*—John K. Crump

[57] ABSTRACT

A roller-gear drive means for the rotary filler head portion of a container filling machine having a stationary base portion which is equipped with a pair of rotary starwheel units for directing containers into and out of the filler head, comprising a drive motor mounted in the base portion in direct driving relationship with a first of the starwheel units through a pair of gear means secured one to the driveshaft of the motor and one to the mounting shaft of the aforesaid first of the starwheel units. The mounting shaft of said first starwheel unit is further provided with an epi-cycloidal gear extending horizontally inwardly under the filler table portion of the head and engaging the head for rotary motion through a series of roller or pins means supported in equi-circumferentially spaced relation to one another around the periphery of the filler table by fixed, vertical rod means forming a part of the lift assemblies which serve to move the containers into and out of filling positions in the filling head during the course of a container filling cycle. The mounting shaft of the other of the starwheel units also carries an epi-cycloidal gear arranged in the horizontal plane of the roller or pin means of the container lift assemblies and adapted to be engaged by said pin means in the operation of the filler so as to be rotated in a predetermined fixed relation with the head and with the other starwheel unit.

9 Claims, 5 Drawing Figures

DRIVE MECHANISM FOR CONTAINER FILLING MACHINE

BACKGROUND OF THE INVENTION

1. Field of the Invention

This invention is directed to a container filling machine and more particularly concerns the drive means for rotary type filling machines such as are used in the brewery and soft drink industries for the high speed, automatic filling of containers, e.g. bottles and cans, with beverage.

2. Description of the Prior Art

Container filling machines of the type with which the present invention is primarily concerned are comprised generally of a stationary base and a filler head mounted in the base for rotary motion about a vertical axis through the center of the head. The head is formed with an upper filler bowl portion containing the liquid which is to be introduced into the containers and equipped with a series of depending filler valve assemblies which serve to control liquid flow into the containers. The containers are supported in the head by a lower filler table or turntable connected to the bowl for rotation therewith as an assembly and provided around its periphery with a series of container support and lift assemblies which serve to receive the incoming containers and to move the same relatively into and out of filling position with respect to the valve assemblies in the course of a container filling cycle.

The containers are normally delivered into the filler head through means of a timing screw and a multiple pocketed rotary member such as a starwheel which co-act to impart a predetermined spacing to the containers such that upon entry to the head the containers are received properly upon the container lift assemblies. An additional multiple-pocketed rotary member, i.e., starwheel, is normally also mounted in the base of the filler to receive the containers from the head at the completion of the filling cycle and to deliver the same directly to a crowner or capper unit in those instances wherein the crowner/capper is formed as an integral part of the filler or to a suitable take-off conveyor where the crowner/capper constitutes a separate, free standing unit.

In the typical such filling machines, the drive system includes a main power source such as a variable speed drive motor mounted in the base of the filler with the drive shaft of the motor extending horizontally in the base and supported in suitable bearings or pillow blocks. The filler table is provided with a large diameter ring gear mounted horizontally of the table in centered relation to the axis of rotation of the head proper. A spur gear which is mounted in the base of the filler in driving engagement with the ring gear is coupled by way of gear reducer and a timing chain-sprocket unit to the motor driveshaft whereby to rotate the head when the drive motor is energized. The mounting shafts of the infeed and discharge starwheels are each normally provided with a ring gear and are coupled to the driveshaft of the motor to rotate in a predetermined timed relation to the head through additional gear reducers and separate timing chain-sprocket units.

In the case of a filler having a crowner or capper unit as an integral part thereof, the drive system usually further includes additional timing chain and sprocket power take-off units coupling the main driveshaft to both the rotary head of the crowner/capper and the crowner/capper discharge starwheel with suitable gears and gear reducer unit being utilized to provide a desired speed correlation between these elements and the filler head and its starwheels.

While this general type of drive arrangement has long been accepted in the industry as standard, there are a number of inherent drawbacks in such a drive. For one thing, the use of multiple component, more or less independent drive trains for the filler head, each of the filler starwheels and the crowner/capper head renders it difficult, even with the exercise of close control over manufacturing tolerances and component specifications, to attain precise timing between the filler head and the feed and discharge starwheels. Moreover, operational wear in, and between, the drive components leads to further problems in maintaining precise control of timing in the filler over extended periods of filler operation. The lack of timing precision in the filler results in a rough or irregular handling of the containers at the container infeed and discharge zones and to lack of exactness in container placement on the container support and lift assemblies. In addition to leading to irregular or unsatisfactory filling of the containers, the lack of correct timing leads to excessive wear in the various container handling parts of the filler and its associated infeed and discharge starwheels. The absence of a smooth passage of the containers into and out of the filler head and the loss of precision in the placement of the containers on the lift assemblies of the filler head is particularly burdensome at the high container handling speeds required in present day fillers and, if not rectified, requisite filler speed and production outputs cannot be maintained. The use of added and dimensionally more exact container handling parts in the container infeed and discharge zones as one measure to attain close control over container movement in the critical areas of the filler has been only partially successful in reducing this problem.

A further drawback of the conventional drive arrangement is lack of ready serviceability, the drive components being relatively inaccessible and difficult to adjust with any degree of precision.

The complexity of the described drive arrangement further adds considerably to the initial cost of the filler and is thus objectionable on this further basis.

SUMMARY OF THE INVENTION

The present invention is directed to a drive mechanism for a container filling machine which is of substantially simplified design and which features a novel arrangement of rollers in the filler head cooperating with gears carried by the infeed and discharge starwheels of the filler to drive the head in accurately timed relation with the starwheels.

According to the invention, the base of the filler is provided with a conventional power source, such as a variable speed hydrualic motor, having a driveshaft to which is secured a pinion gear. Mounted in the base of the filler are infeed and discharge starwheels with the mounting shaft of one of the starwheels, preferably the discharge star, being provided along its lower end with a ring gear which is in direct engagement with the pinion gear of the drive motor. Also keyed to the mounting shaft of the discharge starwheel in juxtaposed relation to the ring gear is an epi-cycloidal gear extending inwardly under the outer periphery of the filler table and engaging the filler head for rotation through means of rollers or pin means supported in equi-circumferentially spaced relation to one another around the periphery of the filler table by fixed, vertical rods means constituting a part of the container support and lift assemblies carried by the filler table. The mounting shaft of the other or infeed starwheel is provided with a similar epi-cycloidal gear on its lower end and positioned to be engaged by the roller or pin means of the filler head, thus coupling the infeed starwheel to the filler head.

In a filler having a capper or crowner as an integral part thereof, the central mounting shaft of the crowner/capper head is provided with ring gear disposed in meshing relation with the ring gear carried by the mounting shaft of the filler discharge starwheel thereby forming a simplified driving connection between the crowner/capper and filler. The mounting shaft of the discharge starwheel of the crowner or capper is provided with a ring gear which is in mesh with and driven by the ring gear of the crowner/capper head thus further coupling the crowner/capper discharge starwheel to the filler drive.

According to a particularly novel feature of the invention, the container infeed and discharge starwheels of the filler have a pitch diameter which is equal to that of the respective epi-cycloidal gears with which they are associated. In addition, the pitch diameter of the ring gear which is in direct driving engagement with the pinion gear of the drive motor is the same as the pitch diameter of the filler starwheels and the epi-cycloidal gears.

By reason of this relationship, the container receiving pockets of the infeed and discharge starwheels of the filler will at all times in the operation of the filler be maintained in exact registry with the container support and lift assemblies of the filler head. The containers, therefore, in moving into the filler head from the infeed starwheel will be placed on the exact center of the container support and lift assemblies whereby to assure proper container filling action in the filler and a smooth flow of containers into the filler from the infeed means. Similarly, the containers will as a result of the specified arrangement be caused to pass smoothly from the container lift assemblies into the filler discharge starwheel at the conclusion of the filling cycle, thus contributing further to a smooth, efficient operation of the filler while at the same time minimizing wear in the container contacting parts of the discharge starwheel.

In order to achieve these same benefits and advantages in container handling in and through the crowner/capper, it contemplated in the invention to provide the crowner/capper head with a pitch diameter which is equal to that of the ring gear associated with the mounting shaft of the crowner/capper. Additionally, the discharge starwheel of the crowner/capper and the ring gear with which is it is associated are of the same pitch diameter.

The drive means of the invention assures a smooth handling of the containers in and through the filler and crowner/capper and enables the containers to be maintained under close control at all times during passage through the unit. Highly accurate filling of the containers may thus be achieved at the high operating speeds required in present day container processing lines.

The drive system of the invention features gear to gear contact throughout, requires little or no adjustment, is capable of providing reliable, trouble-free operation over extended periods of usage and is relatively easy to maintain. A further feature of the described drive system is its relatively low cost.

Other features, objects and advantages of the invention will become readily apparent in the course of the following description of a presently preferred embodiment of the invention, when taken in conjunction with the accompanying drawings.

DESCRIPTION OF THE PREFERRED EMBODIMENT

Figure 1:
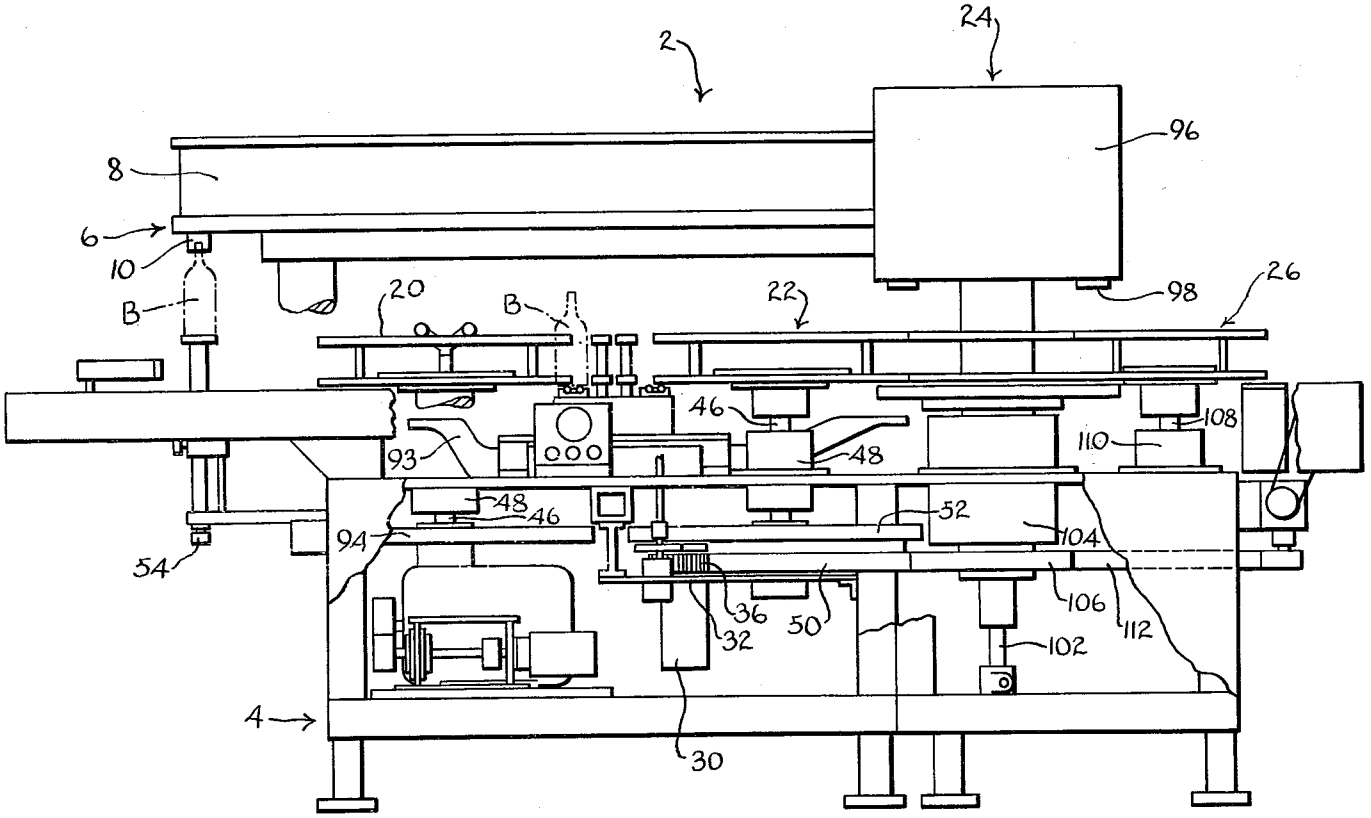
FIG. 1 is a front elevation of a container filling machine incorporating the improved drive system of the invention with parts broken away to reveal details of internal construction.
Figure 2:
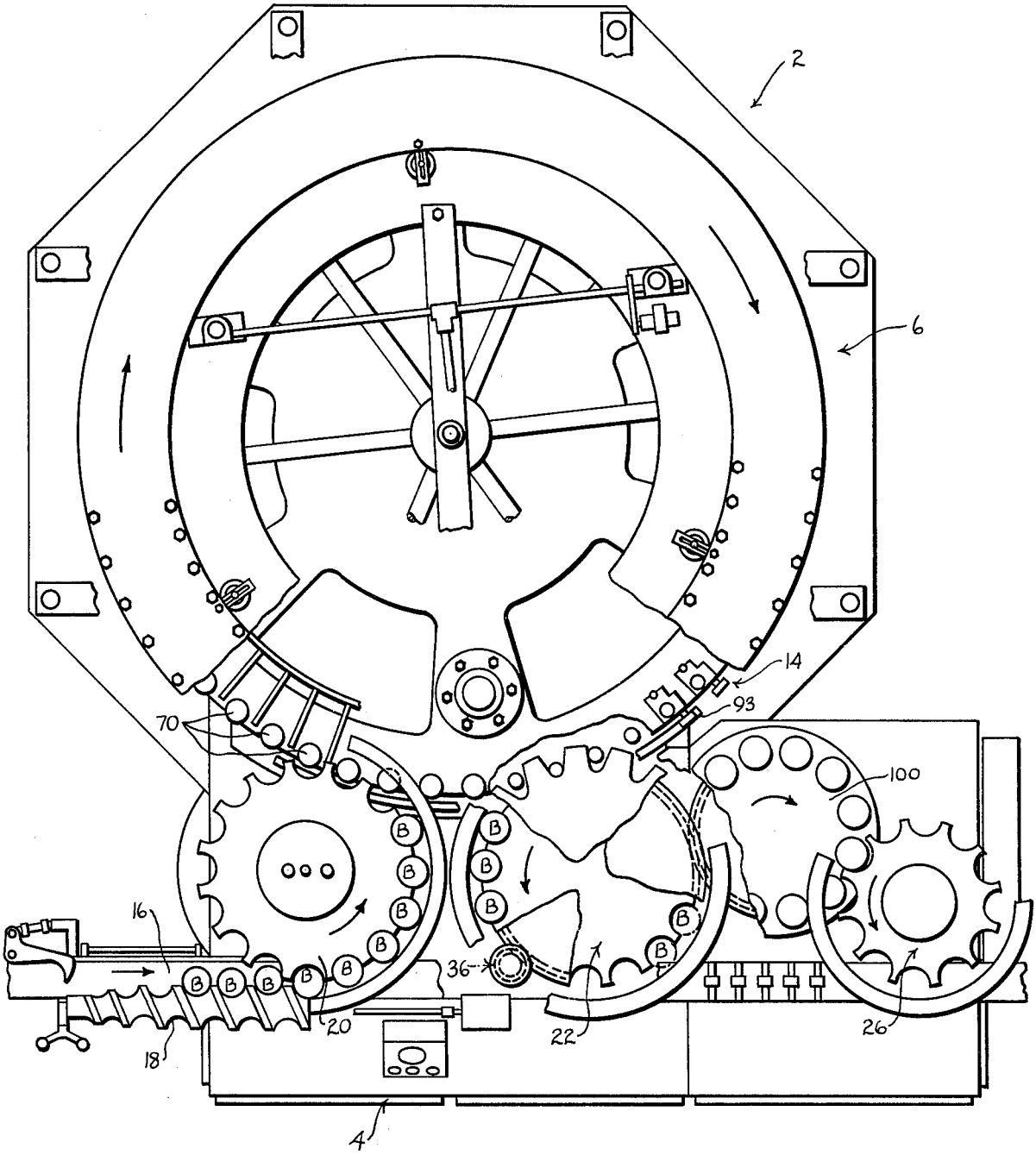
FIG. 2 is a plan view of the filling machine shown in FIG. 1 with parts again being broken away for clarity of illustration.

Referring now to the drawings, a filler machine for containers such as bottles B and indicated as a whole by the reference numeral 2 includes a stationary base 4 supporting a filler head 6 for rotary movement about a vertical axis through the center of the head. The base includes a plurality of plate-like members which are welded or otherwise secured together to form a rigid support structure of generally open construction and equipped with a number of suitable leveling legs or posts secured to the plates as by welding. The filler head is of a generally conventional construction being formed with an upper bowl portion 8 adapted to contain a beverage such as a soft drink or beer which is to be introduced into the containers and provided with a series of equi-circumferentially spaced, dependingly mounted filler valve assemblies 10 which serve to control the flow of liquid into the bottles. The head further includes a lower table-like portion 12 connected with the bowl for rotation as a unit therewith in the operation of the filler. Mounted around the periphery of the table 12 are a series of container support and lift assemblies 14 adapted to receive incoming, empty bottles and to move the same vertically into and out of filling relation with the individual filler valve assemblies 10 in the course of a container filling cycle.

The bottles are delivered to the filler for processing by an endless conveyor 16 of any suitable construction trained over and around sprocket means (not shown) carried in the base. Associated with the conveyor 16 is a timing screw 18 designed to impart a predetermined spacing to the bottles as they approach an entry position to the filler head. From the timing screw, the bottles feed to a rotary mounted starwheel 20 which then carries the bottles onto the container support and lift assemblies 14 of the filler head while maintaining the spacing between established by the timing screw. Suitable fixed guides of arcuate contour are associated with the starwheel to confine the bottles to the pockets of the same as they pass from the timing screw into the filler head.

The bottles are removed from the filler head after completion of the filling operation by a second starwheel 22 located in the base of the filler generally adjacent to the first mentioned starwheel 20. Starwheel 22 is also provided with suitable fixed guides which serve to direct the bottles properly into the pockets of the starwheel from the container support and lift assemblies and to retain the bottles in the pockets as the starwheel is rotated whereby to direct the bottles into a desired path of travel from the filler table.

In the particular filler selected for purposes of illustrating the invention, the base of the filler further mounts a rotary crowner or capper 24 and the bottles, after completion of the filling operation, are transferred by starwheel 22 directly to the crowner/capper, the guides associated with starwheel 22 being located and contoured in a manner as to guide the bottles in the desired manner from the filler head to the crowner or capper. A still further starwheel assembly 26 is mounted in the base of the filler to receive the bottles from the crowner/capper 24 and to direct the same onto a discharge means such as an endless conveyor 28 which serves to transmit the bottles to associative processing equipment such as for example, a labeler (not shown).

With the above generally by way of background, reference may now be made to the means by which the various bottle handling and processing components of the filler and the crowner-capper are driven. Heretofore, it has been customary to drive the head of the filler through means such as a variable speed motor having an elongated horizontally extending driveshaft connected by a timing chain and sprocket unit and one of more intermediate gears and a gear reducer unit to a large diameter bull or ring gear attached directly to the underside of the filler table. The infeed and discharge starwheels of the filler were normally coupled to the driveshaft of the power source through additional sprocket and timing chain units, and/or gears and gear reducer units designed and arranged in a manner as to impart a predetermined speed correlation between the starwheels and filler head. In the case of a combined filler-crowner/capper unit such as that under present consideration, the usual practice has been to couple the crowner head to the filler drive motor through additional timing chain and sprocket units, and/or gear and gear reducers arranged to provide a desired speed correlation between the filler and crowner/capper. Additional gearing including another timing chain and sprocket unit and gear reducer unit were utilized to couple the crowner/capper discharge starwheel to the driveshaft of the drive motor. While this conventional drive arrangement has been generally satisfactory, the relatively complex nature of the system and its reliance on timing chains and the like created problems in initially establishing and thereafter maintaining accurate synchronization of movement among the various starwheels, the filler head and the crowner/capper head. This led to such things as a rough, irregular handling of the bottles in the filler, a high rate of wear in the bottle handling and/or contacting parts, irregular filling of the bottles, and a relatively low over-all operating efficiency of the filler and crowner/capper unit. The complexity of the drive system further resulted in a filler having a relatively high cost of manufacture.

In order to obviate these and other shortcomings of existing drive systems, the present invention contemplates a drive arrangement for the filler which includes a conventional power source herein shown as a variable speed hydraulic motor 30 mounted on a suitable base plate 32 in the lower portion of the filler base 4.

The driveshaft of the motor indicated by the reference numeral 34 extends vertically upwardly and has a pinion gear 36 keyed thereto.

Starwheels 20 and 22 are constructed generally indentically to one another, being comprised of upper and lower disc-like members **38*a*, 38*b* provided with a series of uniformly spaced, semi-circular cutouts or pockets 40*a*, 40*b* for receiving the bottles and secured one to another in spaced apart, planar relationship by machine screws 42 received within tubular spacers 44 mounted vertically between the discs. The disc-like members are supported as an assembly in the base of the machine by a suitable hub (not shown) keyed to a center mounting shaft 46 which in turn, is journalled within a bearing 48** fixedly mounted in the machine base.

Secured to the lower end of the mounting shaft of one of the starwheels 20 and 22, and in the illustrated embodiment of the invention, the discharge starwheel 22, is a pair of gears 50 and 52 disposed in pancaked relation to one another and secured to one another for rotation as a unit with the shaft by suitable machine screws.

Gear 50, the lowermost of the two gears, is in the form of a bull gear and is disposed in direct engagement with pinion gear 36 so as to be driven directly by the latter and thereby power the starwheel for rotation when the drive motor is operative.

The other of the gears 50 and 52 is in the form of an epi-cycloidal gear. As is best brought out in FIG. 3 of the drawings, gear 52 projects inwardly under the outer periphery of the filler table and is in direct driving engagement with the filler head through the medium of a series of rollers or pins 54 forming an integral part of the aforesaid container support and lift assemblies 14 of the filler table 12. Assemblies 14 are identically constructed and mounted in the filler table and it will be understood therefore that the showing in FIG. 4 of one such assembly and the following description thereof applies equally as well as to all the lift assemblies. In general, each of the assemblies 14 is basically comprised of a fluid pressure piston cylinder unit 56 carried vertically within a suitable bore in a hanger support portion 58 of the filler table. The piston portion of the unit indicated by the reference numeral 60 is in the form of a tubular rod or shaft having a stepped, threaded lower end portion projecting below the hanger support and adapted to receive a lock nut 62 which coacts with a shoulder in the end of the piston to hold the same in captive position on the hanger. The cylinder member 64 of the unit is received over the piston above the hanger support 58 for free sliding movement in a vertical direction. Mounted within the upper end of cylinder 64 is a plug or closure 66 secured in place by a pair of snap rings fitting in suitable grooves in the base of the cylinder one to either side of the plug. An O-ring is provided for sealing plug 66 to the cylinder 64. Mounted to the upper end of the cylinder as by a cap screw 68 threadingly received in a central, threaded bore in plug 66 is a disc-like member or pad 70 which constitutes a support for the containers being handled in the filler, the screw attachment permitting ready removal and replacement of worn or damaged pads.

Cylinder movement relatively of the piston is controlled in part by a cam roller 72 supported on the cylinder for rotation on a horizontal axis by a split bracket 74 fitting over and around the lower end of the cylinder and clampingly secured thereto by suitable machine screws 76 extending between the open or split side of the bracket. Cam roller 72 is affixed to bracket 74 by a stud 78 with washers being provided to permit the roller 72 to rotate freely on the stud. Bracket 74 is provided along its radially inner wall with a pair of vertically extending ears or lugs 80 fitting between upper and lower sets of lugs 82 of a centrally bored bushing 84 carried on a guide rod 86 fixedly secured to hanger support 58 directly radially inboard of piston-cylinder unit 56 whereby to guide the cylinder for vertical slide movement on the piston concomitantly while holding the cylinder against rotative movement relatively of the piston. A bumper 88 of a suitable material is secured to the upper end of guide rod 86 to limit the cylinder for upward slide travel on the piston 60.

The aforesaid roller or pin 54 of the filler head drive means is carried on the shaft or piston below the hanger support, being held in place on the shaft by a retainer ring 90.

The lower end of piston 60 is coupled through a suitable fitting to an inlet line 92 leading from a central source of fluid pressure such as compressed air (not shown) to provide fluid pressure to the unit during filler operation.

It is to be noted at this juncture that in the filling of a container the cylinder 64 is actuated to its raised or extended position at the outset of the filling cycle by air or fluid pressure admitted through line 92 and is held in such position through substantially the complete filling cycle. The cylinder is adapted to be restored to its retracted or lowered position at the end of the filling cycle through a conventional cam plate 93 located at a predetermined location on the periphery of the filler table in a position to be engaged by cam roller 72 when cylinder 64 is in its extended or upper slide position, the cam plate 93 being contoured to drive the cam roller and cylinder downwardly as the lift assembly moves arcuately along the length of the plate at said predetermined location.

While the cylinder may be constructed of any one of a number of conventional materials, in a preferred embodiment of the invention the cylinder is formed of an inner sleeve consisting of a woven fabric of Teflon and Dacron fibers (80% teflon, 20% dacron) and an outer shell, formed of fiberglass filaments, wrapped or wound around the sleeve and bonded thereto by an epoxy resin. This material affords an extremely high strength to weight ratio thereby permitting significant reductions in the over-all mass of the rotating structure which in turn enables a reduced power requirement in the filler. The described material is further characterized by a low coefficient of friction to the point that lubrication of the piston-cylinder further offers an imperviousness to chemical and galvanic corrosion.

With further attention to the rollers or pin means 54 and the driving relationship between the aforesaid epicycloidal gear 52 of the container feed star 20 and the rollers, it is to be understood that the lift assemblies 14 and hence the rollers are located around the periphery of the filler table in equi-circumferentially spaced relation to one another whereby to present a continuous series of regularly spaced gear teeth to the epi-cycloidal gear 52. The head will thus be driven for rotary movement in a predetermined phased relation with starwheel 20 controlling the feed of containers from the container support and lift assemblies 14. It is to be noted too that with the described system, the filler head gear teeth presented by rollers 54 have the same pitch as the container support and lift assemblies 14 and inasmuch as epi-cycloidal gear 52 which drives the filler head acts through these gear teeth the task of initially attaining and thereafter maintaining a high degree of precision in the timing between the starwheel and filler head is considerably eased. Precise control over container travel in the filler may thus be exercised and even at high speeds the containers will pass smoothly into and out of the filler head.

The other of the starwheels, viz., the feed starwheel 20, also carries an epi-cycloidal gear 94 which is identical in construction to the aforesaid gear 52. As in the earlier instance, gear 94 is mounted to the lower end of the mounting shaft of starwheel 20 and also meshes and is engageable with the rollers 54 of the container lift assemblies 14 so that in the operation of the filler starwheel 20 will be caused to rotate in the desired sequence or phase with both filler head 16 and the discharge starwheel 22.

With regard now to the drive for the crowner and the crowner discharge starwheel, it is to be initially noted that the crowner may be of any conventional or known design and which includes a rotary crowner head 96 containing a series of individual crowner heads or units 98 supported around the periphery of the head for vertical movement relatively between a lowered container engaging or crown applying position and a raised inoperative position. The head includes a lower plate 100 for supporting the containers during travel through the crowner. Crowner head 96 is supported in the base of the machine by a center mounting shaft 102 journalled in suitable bearings 104 in a support wall of the base. Shaft 102 extends downwardly within base 4 and is keyed to a ring gear 106 disposed in the plane of the aforesaid ring gear 50 carried by the filler discharge starwheel 22 and in direct meshing or driving relationship thereto.

Figure 3:
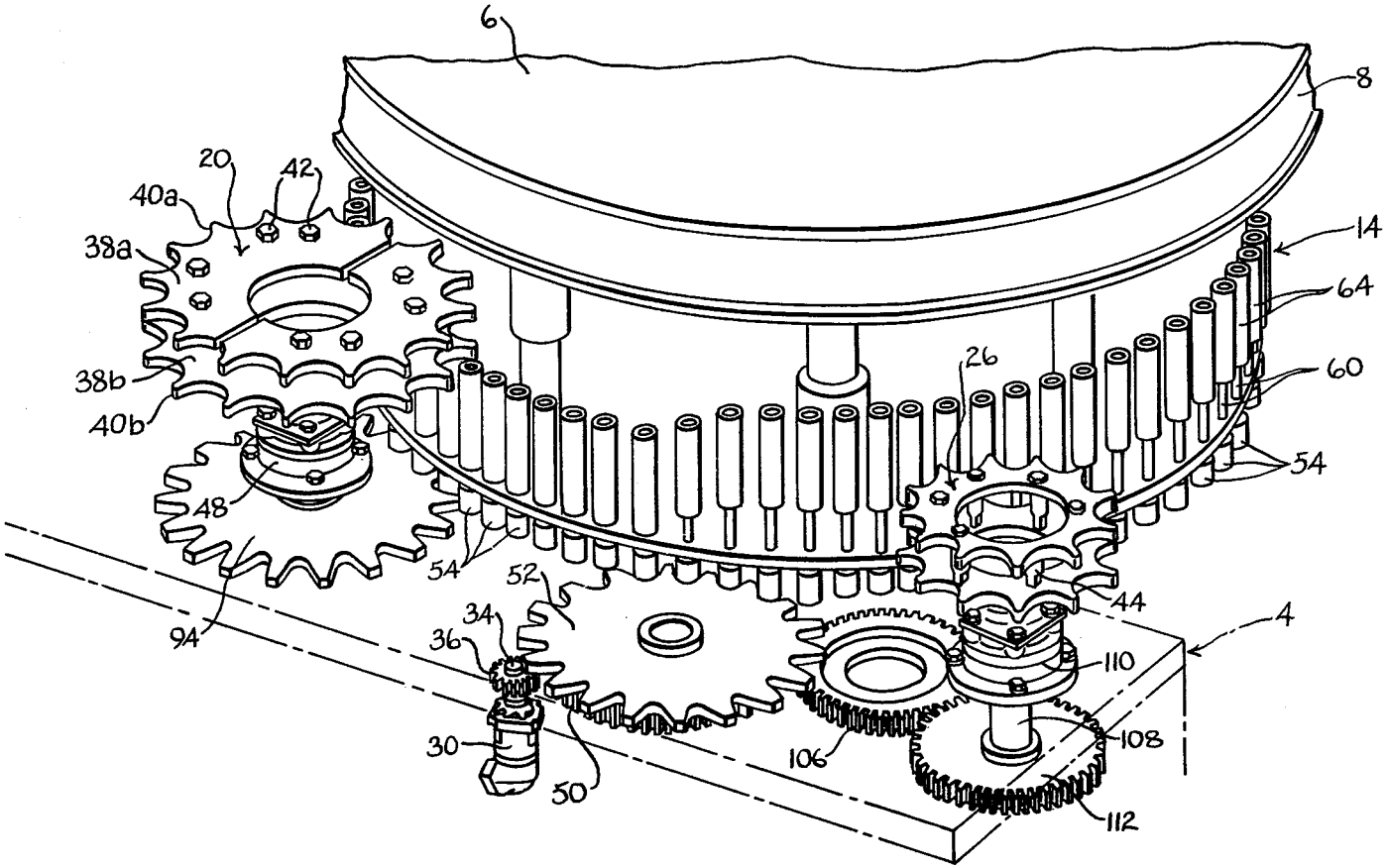
FIG. 3 is a perspective view, on an enlarged scale, of the portion of the filling machine containing the various gears of the filler drive system with parts being removed for purposes of revealing details of construction.
Figures 4, 5:
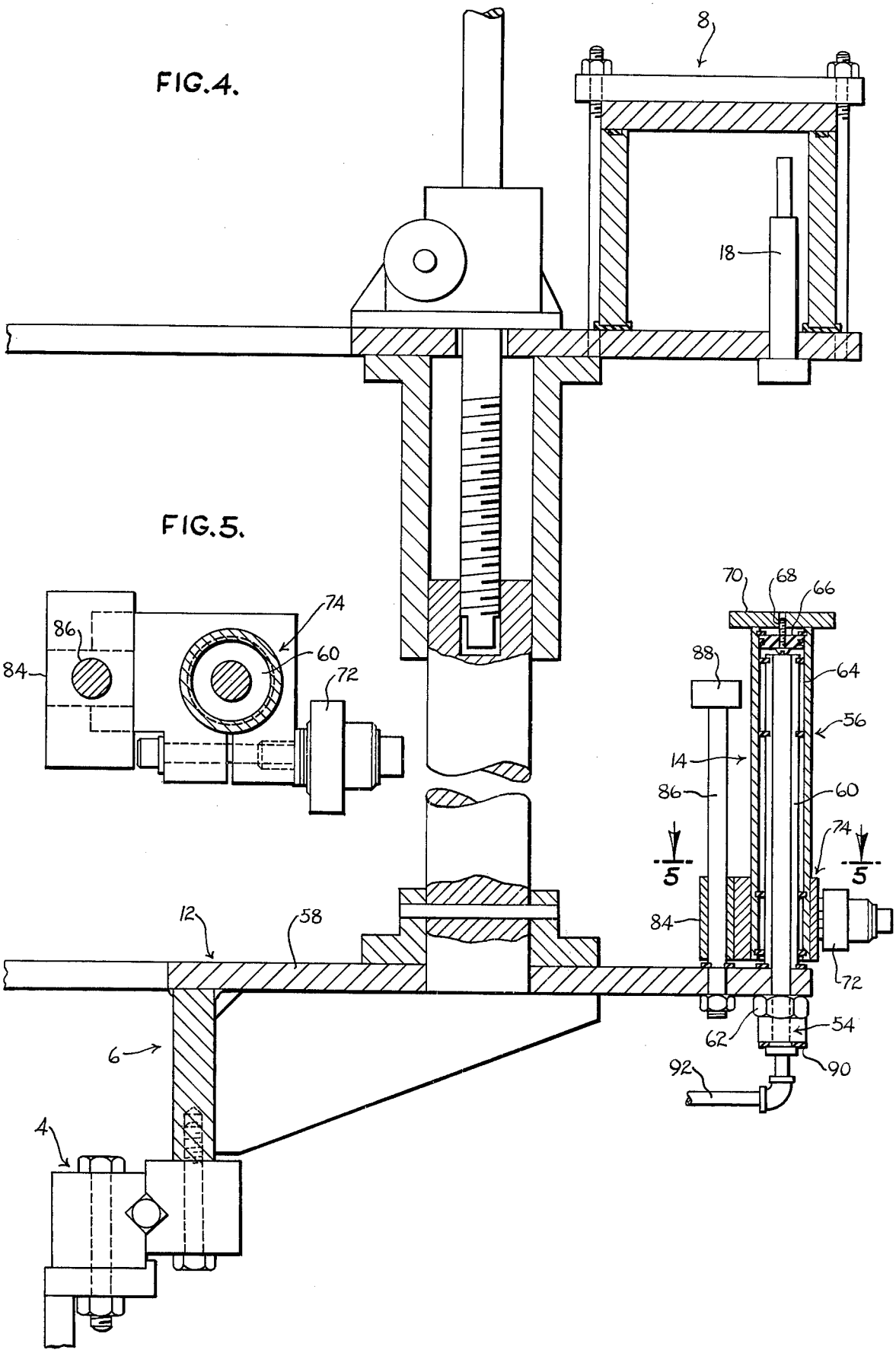
FIG. 4 is an enlarged side view, partly in elevation and partly in section, of a portion of the filler containing one of the novel container support and lift assemblies of the invention.
FIG. 5 is a view taken along the lines 5—5 of FIG. 4 showing further details of a container support and lift assembly of the filling machine.

The crowner discharge starwheel 26 is of a similar construction to the starwheel 20 and 22 of the filler infeed and discharge, being comprised of a pair of like shaped and configured circular plates provided with a series of equi-spaced arcuate cutouts or pockets for receiving containers and secured one to another in facing relation by means of machine screws and spacers. Starwheel 26 is carried in the base of the filler on a center mounting shaft 108 journalled in suitable bearings or blocks 110. The shaft 108 extends below the plane of the top of the base and is provided along its lower end with a relatively large diameter ring gear 112 which as is brought out best in FIG. 3 is in meshing engagement with the driven gear 106 of crowner head 96 whereby to drivingly couple starwheel 26 to the main drive of the filler. It is to be observed that in the above described drive means, all driving connections to and between the various operative assemblies of the filler and crowner/capper unit are effected through pairs of gears which are in direct engagement with one another. Further, in the case of the filler head wherein the drive is effected through the roller or pin means 54 of the container support and lift assemblies 14, it is to be noted that not only is there a one to one relationship between the gear teeth and the bottles or other containers being processed in the filler but also the gear teeth themselves are positioned on the vertical centerline of the support pads 70 of the container lift assemblies 14 and thus are coincident with the longitudinal axis of the bottles during the processing of the same in the filler. This greatly simplifies the coordination of the speed of the filler head to the movement of the bottles into and out of the filler head and results in a filler with for all intents and purposes cannot attain an out of "timing" condition with respect to the bottles being processed therein. The adverse effect which such things as wear, tolerance build-up and play, in and between the gears. bearings and other members of more conventional drive systems exert on timing are completely avoided by the drive means of the invention.

In order to attain absolute precision in the placement of the bottles on the container lift assemblies of the filler head at the container infeed to the filler head and to assure a high degree of exactness in the registration of the pockets of the discharge starwheel with the bottles at the point where the bottles leave the filler head, the pitch diameters of the starwheels 20 and 22 are identical to one another and to the pitch diameter of the respective epi-cycloidal gears 94 and 50 with which they are associated. Further, the pitch diameter of the ring gear 50 is identical to that of gear 52. By virtue of this relationship in the pitch diameters of the various alluded to members, the bottles are assured of a highly accurate placement on the container lift assemblies upon entry into the filler head. Similarly exact registration of the bottles with the pockets of the discharge starwheel 22 at the point when the bottles leave the filler head is assured. This assumes, of course, that the assemblies of the discs **40*a* and 40*b* of the respective starwheels 20 and 22 are secured to their respective mounting shafts with the proper rotative orientation. A key and enlarged slot arrangement may be provided for securing the discs to the mounting shafts 46 to facilitate the attainment of the requisite orientation of the disc assemblies on their respective shafts 46**.

To this same end, the invention contemplates the provision of a pitch diameter for the driven ring gear 106 of the crowner/capper unit which is identical to the pitch diameter of the container support plate 100 of the crowner/capper unit. Also, the pitch diameter of the driven gear 112 of the crowner/capper discharge starwheel 26 is made equal to the pitch diameter of the latter.

With the arrangement described, the bottles are maintained under positive, close control in all phases of both the filling and the crowning or capping operations, thereby reducing wear in the various bottling handling parts of the filler and the crowner/capper. Additionally, with the drive of the invention, the filler itself is enabled to satisfactorily fill bottles at extremely high rates of bottle movement through the filler; filler efficiency and output are significantly increased as a result of the present improvements.

The drive of the invention is further characterized by a relatively low cost and by a requirement of relatively little maintenance. The rollers or pin means are readily accessible and, if worn or damaged, can be readily removed and replaced by simply removing the retainer ring holding the same onto the lower end of the piston portion of the container lift assemblies. The rollers may be in the form of commercially available units and as opposed to the conventional practice of equipping the turntable with a large diameter precision ground, bull or ring gear which is normally heat treated to provide requisite hardness qualities, their use permits substantial savings to be effected in the cost of the filler.

Various modes of carrying out the invention are contemplated as being within the scope of the following claims particularly pointing out and distinctly claiming the subject matter regarded as the nature of the invention.

I claim:

1. In a container filling machine having a stationary base and a filler head mounted in the base for rotary movement about a vertical axis, the base being equipped with first and second, rotatably mounted starwheel units for delivering containers into the filler head for filling action and for receiving containers from the head when filling is completed, and the filler head being provided with an upper liquid reservoir containing a series of depending filling valve assemblies for controlling liquid flow into the containers and with a lower turntable having a series of container support and lift assemblies mounted around its periphery in equi-circumferentially spaced relation to one another for receiving incoming containers and for moving the same into and out of filling positions relatively of said filling valve assemblies during the course of a container filling cycle, a drive means for the filler head and starwheel units, comprising a main power source mounted in the base of the filler, first and second driven gears associated with a first of the starwheel units and secured for rotation therewith as a unit, a drive gear connected to said power source in direct driving relation with said first starwheel unit through a first of said driven gears, a roller means associated with each of said container support and lift assemblies and supported thereby in a fixed horizontal plane, said second driven gear of said first starwheel unit supported in said fixed horizontal plane and engageable with said roller means to drivingly connect said power source to said filler head, and a third driven gear carried by said second starwheel unit in the horizontal plane of said roller means and engageable by said roller means whereby to drivingly connect said second starwheel unit to said power source.

2. The construction of claim 1 wherein said first and second driven gears associated with the first of said starwheel units have a common axis of rotation with said starwheel unit and wherein the pitch diameters of said driven gears and said starwheel unit are all equal.

3. The construction of claim 1 wherein said third driven gear associated with said second starwheel unit has a common axis of rotation with said starwheel unit and wherein the pitch diameters of said third driven gear and said second starwheel unit are equal to one another.

4. The construction of claim 1 wherein said roller means associated with said container support and lift assemblies are supported for rotation on a vertical axis, and wherein the second of said driven gears associated with a first of said starwheel units and said third driven gear carried by said second starwheel unit are epicycloidal gears having a rolling contact with said roller means.

5. The construction of claim 1 wherein said roller means are located on a vertical center axis which is coincident with the vertical centerline of the respective container support and lift assemblies with which they are associated.

6. A container support and lift assembly adapted to be mounted in the lower turntable portion of a rotary type, container filling machine for moving containers being processed in the filler relatively between lowered and raised, filling positions in said machine as the containers are advanced around the pitch circle thereof, there being an upper liquid reservoir rotatable as a unit with said turntable and equipped with a series of equi-circumferentially spaced, dependingly mounted filler valve assemblies for directing liquid into the containers when in raised, filling position thereto which comprises a piston member adapted to be fixedly mounted in the turntable in vertically aligned relation with one of said filler valve assemblies, a cylinder member adapted to be slidingly mounted to said piston member above said turntable portion and closed at its upper end by a pad constituting a support for said containers, and a roller means adapted to be rotatably mounted to the lower end of said piston member below the turntable, said roller means forming a part of a gear tooth drive mechanisms for said turntable and said liquid reservoir.

7. The construction of claim 6 wherein said piston member is of tubular construction and is adapted to be connected through its lower end to a fluid pressure inlet line whereby to permit controlled application of fluid pressure to said cylinder member to move the same to an extended, upper slide position relatively of said piston member.

8. The construction of claim 6 wherein the cylinder member is formed of an inner sleeve consisting of a woven fabric of Teflon and Dacron in an approximate 4 to 1 ratio to one another, and an outer shell formed of fiberglass filaments wrapped around said sleeve and bonded thereto by an epoxy resin.

9. A gear tooth mechanism for the drive of a filler head of a container filling machine of the rotary acting type, the head having a lower turntable provided around its periphery with a series of equi-circumferentially spaced lift assemblies for supporting the containers for filling action in the head and further having an upper liquid reservoir provided with a series of equi-circumferentially spaced, dependingly mounted filler valve assemblies for controlling filling flow of liquid to the containers, which comprises a roller means connected to the lower end of each of the lift assemblies, said roller means mounted in a fixed horizontal plane and freely rotatable relatively of a vertical axis through the center of said lift assemblies whereby to present a continuous series of gear-like teeth around the periphery of the turntable.

* * * * *